US005195593A

United States Patent [19]

Cassin

[11] Patent Number: 5,195,593

[45] Date of Patent: Mar. 23, 1993

[54] CYLINDRICAL STACK FOR CONFINING AND EXTINGUISHING AN OIL WELL FIRE

[76] Inventor: Allen E. Cassin, 1750 Day Dr., St. Clair, Mo. 63077

[21] Appl. No.: 712,344

[22] Filed: Jun. 7, 1991

[51] Int. Cl.[5] ..... A62C 3/06

[52] U.S. Cl. ..... 169/46; 169/69

[58] Field of Search ..... 169/69, 43, 46, 48, 169/52

[56] References Cited

U.S. PATENT DOCUMENTS

| | | | |
|---|---|---|---|
| 1,807,498 | 5/1931 | Teed | 169/69 X |
| 4,323,118 | 4/1982 | Bergmann | 169/69 X |
| 4,433,733 | 2/1984 | Cunningham | 169/69 X |
| 5,115,869 | 5/1992 | Flavio | 169/69 |

OTHER PUBLICATIONS

Bredberg, L. E., "Fire Fighters Face Great Obstacles", *The Oil and Gas Journal*, May 7, 1931, p. 137.

*Primary Examiner*—Dennis H. Pedder
*Assistant Examiner*—Andrew C. Pike
*Attorney, Agent, or Firm*—Dodge, Bush, Moseley & Riddle

[57] ABSTRACT

In accordance with an illustrative embodiment of the present invention, a method of extinguishing an oil well fire includes positioning an elongated tubular member in an upright position over the opening of the well with the lower end of the member engaging the ground to substantially contain the flame to the interior thereof and to shut off the supply of air into its lower end, and forming an earth back-fill around the lower end portion of the tubular member to shut off all supply of air into its interior.

11 Claims, 1 Drawing Sheet

CYLINDRICAL STACK FOR CONFINING AND EXTINGUISHING AN OIL WELL FIRE

FIELD OF THE INVENTION

This invention relates generally to methods and equipment for extinguishing an oil well fire, and particularly to the use of a lengthy, large diameter tubular stack that is placed in a vertical position over the remains of the wellhead of a burning oil well to confine the flame to the interior of the stack and to shut off the supply of air which is essential to continued combustion.

BACKGROUND OF THE INVENTION

The large number of oil wells still on fire in Kuwait, even though the rather short Persian Gulf was has been over for many months, attests to the fact that existing technology for dealing with the problem of oil well fires leave much to be desired. A common method being used involves inundating the well site with large quantities of water spray for several days, and then moving a heat-shielded vehicle having a long boom toward the well with an explosive charge on the outer end of the boom. When the charge is positioned over the top of the wellhead in the region before the flame front begins, the charge is detonated to create a large explosion which momentarily depletes all oxygen in the vicinity. This procedure extinguishes the flame so that the oil flow can be dealt with by special equipment, provided the flame is not reignited by hot pieces of metal or the like. In that event the process must be repeated until the flame is out and the flow of oil is under control. Particularly during the period of time between the explosion of the charge and the setting of wellhead equipment there is extreme danger to personnel that the flame may suddenly reignite.

Other techniques that have been proposed are shown in U.S. Pat. No(s). 1,857,788 and 1,921,739. According to the '788 patent, a huge concrete block having a centrally located funnel and pipe is transported on its edge by rail to the well site, and then allowed to fall down onto a previously prepared apron and the dike around the well. The funnel directs the oil flow into the pipe and then a valve in the pipe is closed to shut in the oil well. However there is no practical teaching or suggestion in this patent as to how to build a rail line up to and along side a burning oil well, or how an apron or a dike could be constructed in the presence of such an extremely hot flame. Thus this invention does not believe that this patent represents a truly practical solution to the problem. The '739 patent illustrates a long horizontal pipe that is transported by rail on trolleys to where a downwardly facing funnel at its forward end is over the top of the well bore. The flow of oil is diverted by the funnel into the pipe, and the flame, according to the patent, appears at the outer end thereof. Then the pipe is broken at its center to carry the oil to a storage site. Moreover, it is believed that unless the funnel somehow is sealed with respect to the top of the well, the flame may continue to burn intensely in the region around and above the funnel.

An object of the present invention is to provide a new and improved method and apparatus for extinguishing an oil well or similar type of fire in a simple and reliable manner and in a minimum of time, without the dangers and shortcomings mentioned above.

SUMMARY OF THE INVENTION

This and other objects are attained in accordance with the concepts of the present invention through the use of an elongated, large diameter, open-ended metal pipe that is placed in an upright position over a burning oil well or the like with the lower end of the pipe engaging the ground so that the flame is confined to the interior of the pipe and thus contained. The opening through the pipe is large enough so as not to restrict the flow and thereby cause a back pressure to exist at its base. The engagement of the lower end of the pipe with the ground greatly reduces the supply of air that is available to support combustion within the pipe so that the flame is substantially reduced. To shut off all supply of air at the lower end of the pipe, a back-fill of earth is made around the lower end of the pipe. The shut off should result in extinguishing the flame altogether, but if any remnants remain, they can be extinguished by an inert gas that is applied through suitable fittings in the side of the pipe. Once the pipe is in position, it may be desirable to cool the exterior thereof with water sprays using typical fire-fighting type equipment.

BRIEF DESCRIPTION OF THE DRAWINGS

The present invention has other objects, features, and advantages that will become more clearly apparent in connection with the following detailed description of a preferred embodiment, taken in conjunction with the appended drawing in which.

DETAILED DESCRIPTION OF A PREFERRED EMBODIMENT

Figure 1:
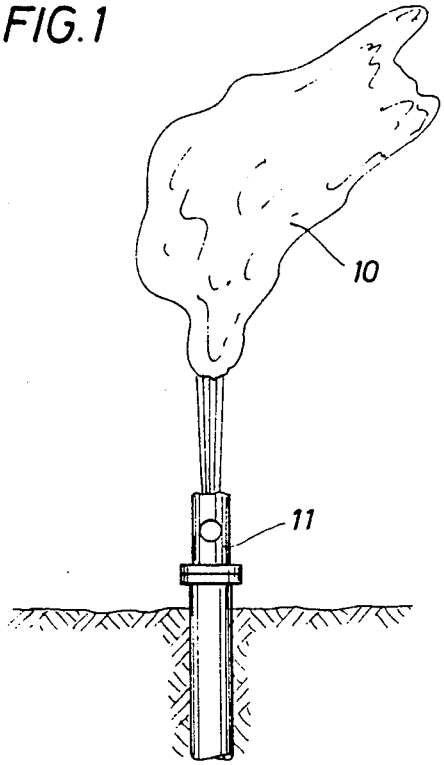
FIG. 1 is a schematic illustration of a burning oil well.

Referring initially to FIG. 1, there is illustrated a burning oil well where an intensely hot flame 10 burns the flow of oil that is issuing from a damaged wellhead 11. Such damage could be caused by the escape of hydrocarbons under pressure through leaking seals or valves, or by the war time sabotage or terrorism, as in the case of the Middle East wells. Of course the flame 10 produces a large amount of black smoke that is hazardous to the environment as well as to persons who are in the area of the well, and must be extinguished as quickly as possible to eliminate the hazard and to prevent further loss of a valuable resource.

In order to extinguish the flame 10 in accordance with this invention, a large metal tube or pipe 12 is used. The pipe 12 preferably is made of a metal such a 309 stainless steel which can withstand excessive and continuous heat. The pipe 12 preferably has a length that is about 4 times its diameter, for example 40 feet long and 10 feet in diameter. The pipe 12 is lifted to a vertical position by suitable means such as a heat-shielded crane, and moved into a position directly over the wellhead 11. Then the pipe 12 is lowered until its lower end rests on the ground around the wellhead 11. Suitable means such as guy lines can be set up to maintain the pipe 12 in the vertical position. The pipe 12 is so massive that no problem is anticipated in getting it into position, even though a large stream of oil is flowing at high velocity from the top of the wellhead 11.

Once the lower end of the pipe 12 engages the ground, the oil flow and flame are confined to the interior thereof. If desired, spray nozzles 13 can be used to direct sprays of water onto the exterior of the pipe 12 to cool same. The engagement of the lower end of the pipe 12 with the ground immediately reduces the availability of air needed to support combustion within the tube, and the flame 10 is substantially reduced. As the lower end of the pipe 12 near ground level, the ambient air pressure around the bottom becomes greater than the pressure inside, so that the flame is drawn within and through the bottom opening of the pipe.

To completely shut off such air supply, a back-fill 15 of earth is made by suitable means to completely close and seal all openings. Such back-fill can be made with relative safety since the oil flow and flame are contained within the pipe 12. The water sprays can be continued during this phase of the process. If desired the back-fill can be sprayed with various foam or other materials which will set up to provide an impervious skin thereon. The completed air shut-off substantially extinguishes the flame altogether. If any remnants remain, they can be extinguished by piping a suitable inert gas such a carbon dioxide or nitrogen into the interior of the tube 12 through suitable inlets 20. Once the flame is extinguished and the wellhead and any debris in the area have cooled down, then the pipe 12 can be removed by crane and set aside, so that other equipment can be used to cap the well.

Figure 2:
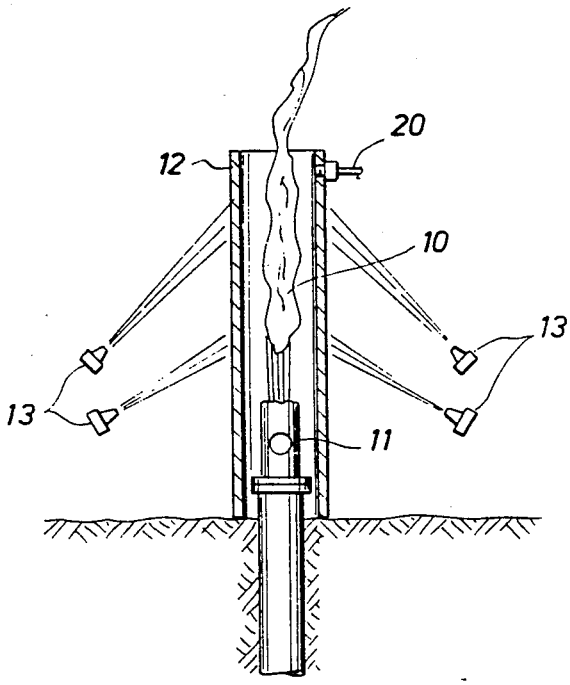
FIG. 2 is a somewhat schematic view of a tubular metal pipe or stack in accordance with the present invention positioned with its lower end portion over the wellhead.
Figure 3:
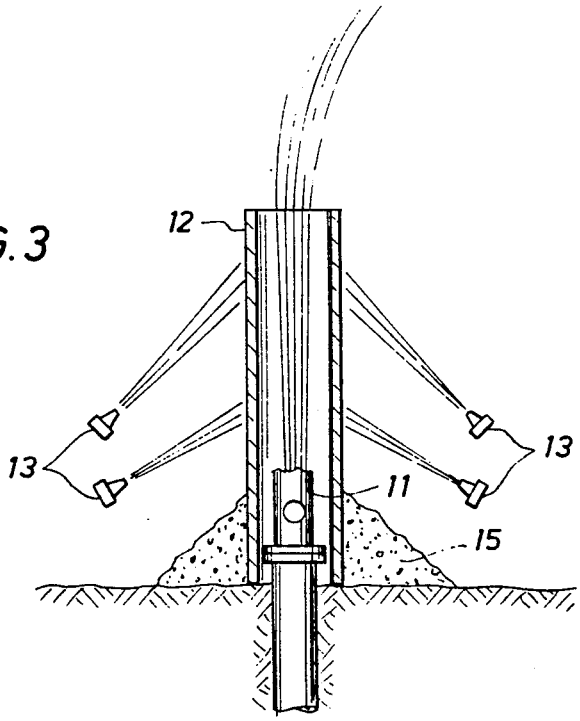
FIG. 3 is a view similar to FIG. 2 and showing a back-fill base of the pipe.

Prior to positioning the pipe 12 as shown in FIG. 2, its bottom end can be altered in shape to allow for clearance due to well piping or to conform to the terrain. Such alteration will ensure that the pipe 12 rests on the ground in a vertical position, and yet leave as little space as possible for the entry of air before the back-fill is made. It also is anticipated that a skirt of a highly heat resistant material such as asbestos be attached to the bottom portion of the pipe 12 to seal off most all of the air flow as soon as the pipe 12 is set down. Although the pipe 12 is shown as having a cylindrical or tubular shape, it could have a square or a rectangular shape, and also could be tapered from its base to its top end.

It now will be recognized that a new and improved process and means have been disclosed for effectively extinguishing an oil well fire. No explosives are used, and the pipe 12 can be positioned by available equipment. The process is relatively simple to implement, and is effective, and obviates the advantages and shortcomings of prior technology and equipment. The methods and apparatus disclosed are effective to contain the fire within an open stack having an inner diameter or size that is large enough so as not to provide a restriction to the flow of oil which would otherwise cause a back pressure that would impede the back-filling procedure. Any such restriction also could cause problems in positioning the stack over the wellhead due to internal pressure. Of course the present invention has application to the extinguishment of types of fires other than an oil well, as will be apparent to those skilled in the art.

Since certain changes or modifications may be made in the disclosed embodiment without departing from the inventive concepts involved, it is the aim of the following claims to cover all such changes and modifications that fall within the true spirit and scope of the present invention.

What is claimed is:

1. A method of extinguishing a flame of an oil well that is on fire, comprising the steps of: positioning a tubular member having an open top end and an open bottom end in an upright position over the well to confine an oil flow and the flame to an interior thereof; and shutting off any flow of air into said bottom end of said tubular member, thereby to at least substantially extinguish the flame.

2. The method of claim 1 wherein said tubular member is made of a heat resistent metal and has a length approximately four times a diameter thereof.

3. The method of claim 1 wherein said shutting off step includes back-filling earth materials around an exterior of said bottom end of said tubular member.

4. The method of claim 3 including the further step of sealing said backfilling of the earth materials to provide an impermeable skin thereon.

5. The method of claim 1 wherein said positioning step includes lifting said tubular member to said upright position, moving said member to a position directly over the well, and lowering the member until said bottom end rests on a ground around a top of said well.

6. The method of claim 1 including the further step of continuously cooling said tubular member after it has been positioned in said upright position.

7. The method of claim 6 wherein said tubular member has external surfaces, and said cooling step includes directing sprays of water onto said external surfaces.

8. The method of claim 1 including the further step of injecting an inert gas into said tubular member to aid in extinguishing the flame.

9. A device for use in extinguishing a flame issuing from a burning oil well, said device comprising: an elongated tubular member having an open top end, an open bottom end, and a hollow interior, said member having a length that is about four times a diameter thereof, said member being adapted to be positioned in a vertical position with said bottom end engaging a ground which surrounds a top of the well; and means surrounding said bottom end of said member for shutting off a flow of ambient air into said bottom end.

10. A device of claim 9 wherein said tubular member has external surfaces, and further including means for spraying water on said external surfaces to cool said member after at least a part of said flame is confined to said interior thereof.

11. The device of claim 9 further including means for injecting an inert gas into said interior to provide further extinguishment of the flame.

* * * * *